US006745478B2

(12) United States Patent
DeLillo

(10) Patent No.: US 6,745,478 B2
(45) Date of Patent: Jun. 8, 2004

(54) MULTI-PURPOSE WORK KNIFE

(76) Inventor: Dominick D. DeLillo, 3216 NE. 13th. St., Pompano Beach, FL (US) 33062

( * ) Notice: Subject to any disclaimer, the term of this patent is extended or adjusted under 35 U.S.C. 154(b) by 0 days.

(21) Appl. No.: 10/197,663

(22) Filed: Jul. 18, 2002

(65) Prior Publication Data

US 2004/0010920 A1 Jan. 22, 2004

(51) Int. Cl.[7] ..... B26B 1/08; B26B 5/00
(52) U.S. Cl. ..... 30/335; 30/172; 30/299
(58) Field of Search ..... 30/142, 172, 299, 30/329, 335

(56) References Cited

U.S. PATENT DOCUMENTS 2,145,985 A * 2/1939 Krajicek ..... 30/294
3,991,467 A * 11/1976 Yokoyama ..... 30/335 X
5,001,796 A * 3/1991 Desjardins ..... 30/172 X
5,174,028 A * 12/1992 Seltzer, Jr. ..... 30/239 X
5,613,300 A * 3/1997 Schmidt ..... 30/335 X
5,643,403 A * 7/1997 Poole et al. ..... 30/172 X
5,924,203 A * 7/1999 Huang ..... 30/142
5,996,231 A * 12/1999 Roche et al. ..... 30/329 X

* cited by examiner

*Primary Examiner*—Charles Goodman
(74) *Attorney, Agent, or Firm*—Melvin K. Silverman

(57) ABSTRACT

A multi-purpose work knife includes a universal elongate ergonomically-shaped handle (UEH) which defines an axis and includes a blade having an UEH blade axis. Within the handle portion, a channel member is received in a forwardly extending cavity and movably receives a cutting blade carrier for axial movement relative to the handle portion. A selectable non-universal portion (SNP) is secured at one end to said UEH at a plane of continuity of curvature thru which the UEH axis passes. The SNP holds non-standard blade at an angular offset relative to the UEH axis. A cutting edge of the SNP blades defines a virtual angle which intersects the UEH axis within a range of 20 to 30 degrees.

16 Claims, 8 Drawing Sheets

MULTI-PURPOSE WORK KNIFE

BACKGROUND OF THE INVENTION

1. Field of the Invention

The present invention relates to work knives and, more particularly, work knives having multiple purposes including, without limitation, cutting, scraping, grouting, and plastering. The knife is further adapted to the particular needs of left handed workers as well as environments in which it would be advantageous to employ one's left hand for a given purpose.

2. Prior Art

The Field of utility knives includes many examples of previous attempts, extending over many years, all of which are directed to the provision of a utility knife which satisfies one or more of the historic concerns associated therewith. These concerns include those of cost, safety, durability, and ergonomics, that is, compatibility with the human hand. A further need in the prior art is that for the storage of spare knife blades within the utility knife itself. A further need, however rarely addressed in the prior art, is that of a utility knife usable for many purposes and, as well, adaptable for use by workers which are both left and right handed.

The traditional trapezoidal-shaped, double-ended utility knife blade has been well known for over sixty years. See, for example, U.S. Pat. No. 2,145,985 (1939) to Krajecik. More recent efforts to improve upon the classical utility knife are reflected in U.S. Pat. No. 5,012,581 (1991) to Fletcher; U.S. Pat. No. 5,490,331 (1996) to Gold; U.S. Pat. No. 5,613,300 (1999) to Schmidt; U.S. Pat. No. 5,623,737 (1997) to Moyer; and U.S. Pat. No. 6,058,607 (2000) to Gringer.

None of this art, nor other art known to the within inventor, discloses a utility knife having a handle surface which is particularly proportioned to the human hand and the gripping function associated therewith when such a knife is held. Further, the prior art does not provide for a utility knife having integrated therewith a non-utility knife portion capable of both cutting and non-cutting functions. Also, the prior art does not provide for a multi-purpose utility knife having a portion thereof which may be selectably changed on the basis of whether or not the user is left or right handed or if a given work assignment, project or problem within a work environment is one in which a "left" versus a "right" handed tool would be more advantageous for such a particular purpose.

The present invention addresses, in an integrated fashion, all of the above long felt needs that have existed in the art of utility knives.

SUMMARY OF THE INVENTION

A multi-purpose work knife, comprises a universal elongate handle ("UEH") extending generally upon a UEH axis, said handle having a compound, convex curvature and an assembly within, at a top surface of a first end of said UEH, for holding a UEH utility knife blade in a selectable longitudinal position defined by a cutting edge of said UEH blade, said UEH also defining substantially oval radial cross-sections between said blade holding assembly and a second end thereof, said cross-sections defining slightly smaller radii at about a center region of said UEH, said second end comprising complemental securement means; and a selectable non-universal portion ("SNP") having a first end and a second end, said second end comprising means for selectable complemental securement to said UEH complemental securement means, said second end of said SNP having a like radius and curvature to said second end of said UEH at opposing surfaces thereof, said UEH axis passing through said complemental securement means of said surfaces of said second ends of said UEH and SNP respectively, said SNP further comprising, at a first end and top surface thereof, an assembly for selectably holding a knife blade having a cutting edge projecting away from said first end of said SNP, in which said cutting edge of said SNP blade defines an angle which intersects said axis of the UEH blade, at a virtual extension external to said work knife, in a range of about 20 to about 40 degrees. Said SNP may selectably take several forms including a left angled axis relative to the axis of the UEH, a right angled axis relative thereto, and an axis substantially co-linear with said UEH axis.

It is an object of the invention to provide a multi-purpose work knife having a universal portion corresponding to the classical function of a utility knife and having a non-common portion which provides for adaptability of the knife to the needs of left versus right handed persons and, as well, affords numerous additional cutting and non-cutting functions.

It is another object to provide a multi-purpose work knife of the above type having a surface curvature and geometry particularly adapted for the requirements of the human hand during the gripping of a utility knife.

It is thereby a further object of the invention to provide an improved multi-purpose knife which is usable with equal facility by both left-handed and right-handed persons.

It is a still further object to provide a work knife which, alternatively, may be employed in numerous non-utility cutting and non-cutting applications.

The above and yet other objects and advantages of the present invention will become apparent from the hereinafter set forth Brief Description of the Drawings, Detailed Description of the invention and claims appended herewith.

DETAILED DESCRIPTION OF THE INVENTION

With reference to views of FIGS. 1 to 6, the present inventive multipurpose work knife 10 may be seen to include a universal elongate handle part 12 (hereinafter the "universal handle") or "UEH" the elongation of which extends generally along an "UEH" axis 14. Said universal handle, as may be noted with reference to FIGS. 1 and 4, defines a compound convex generally cylindrical surface in which a transverse cross-section thereof defines slightly smaller radii at about a center region 16 thereof.

Figure 1:
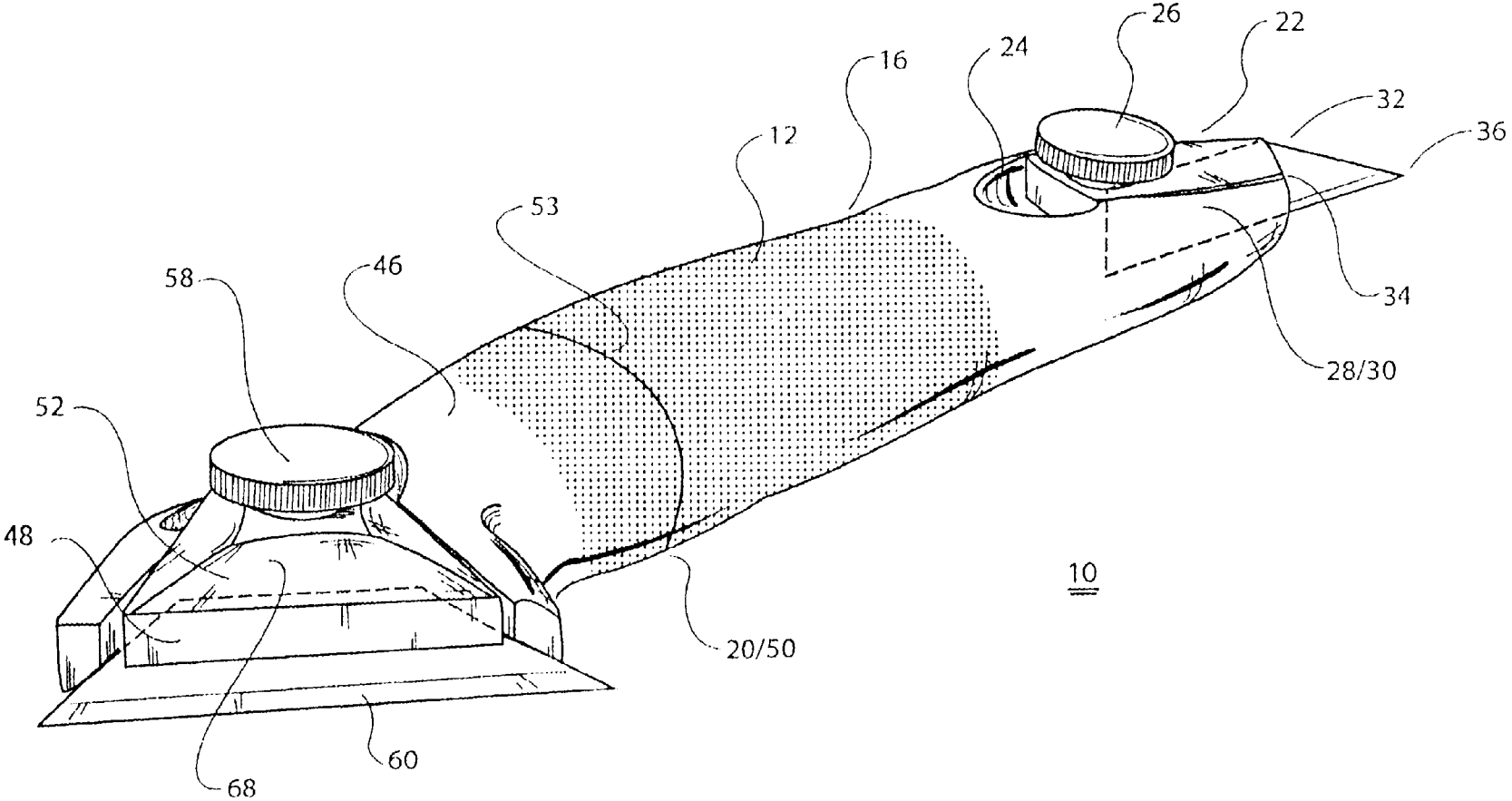
FIG. 1 is a perspective view of the inventive multi-function work knife.
Figure 2:
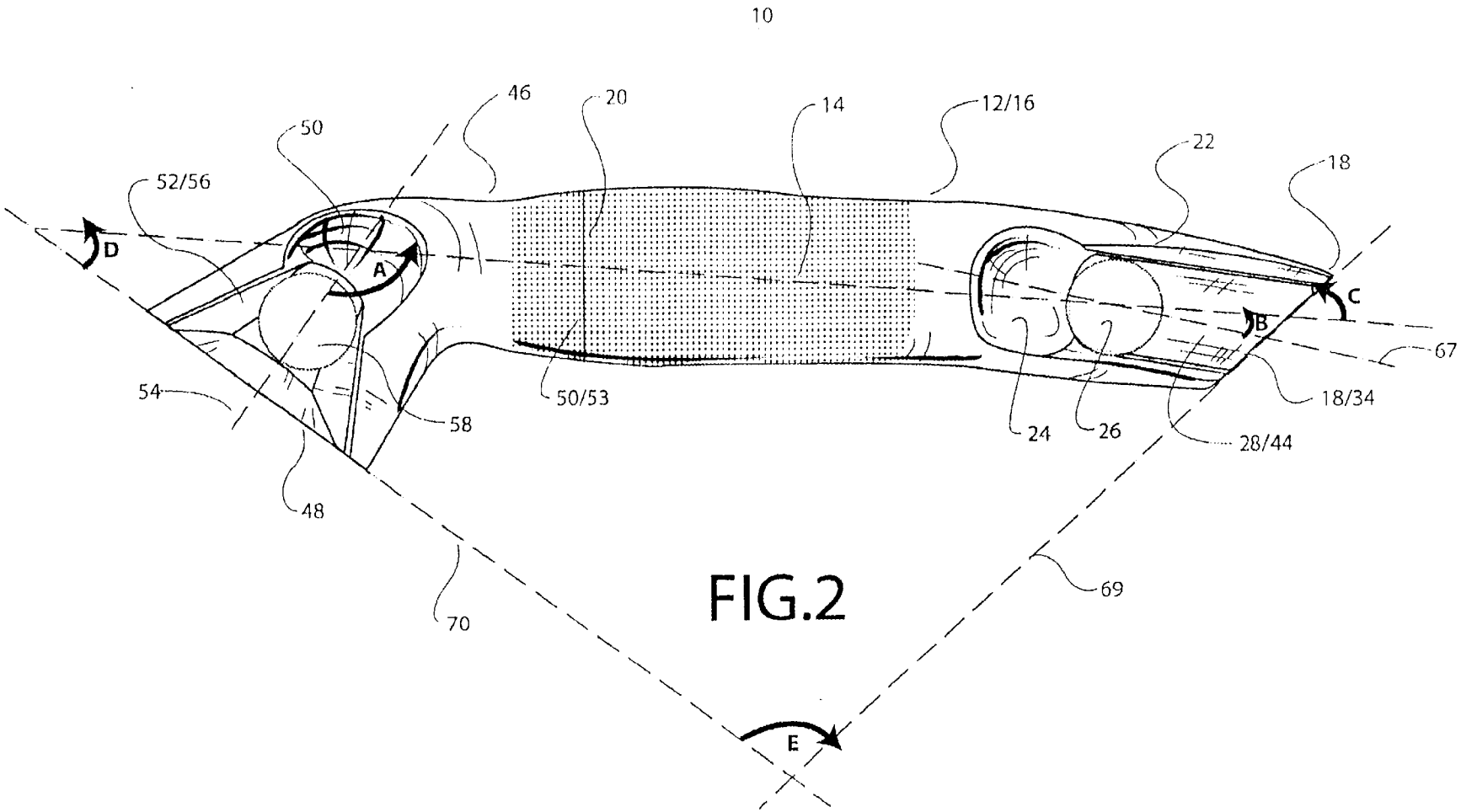
FIG. 2 is a top perspective view of the knife of FIG. 1.
Figure 3:
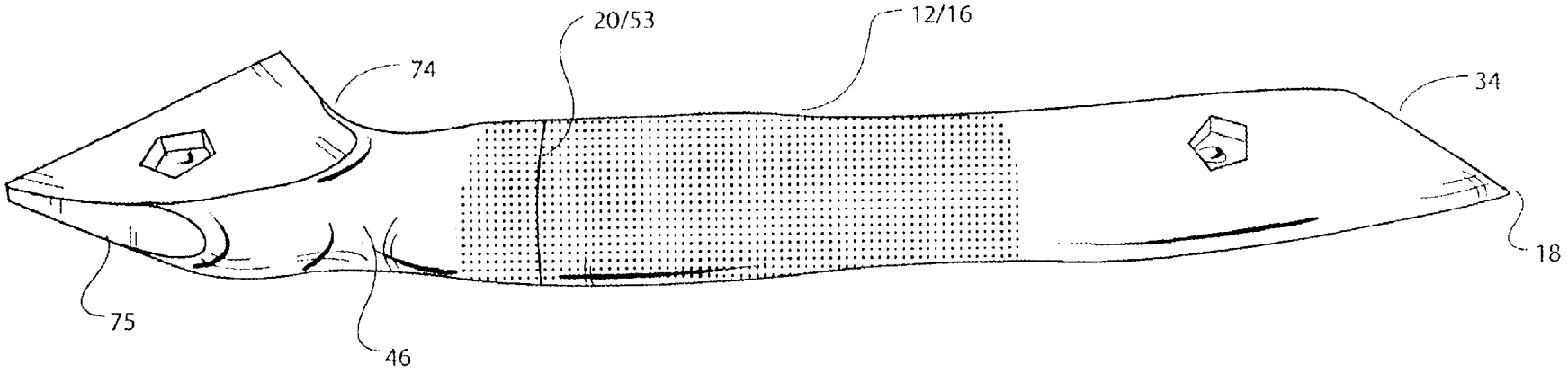
FIG. 3 is a bottom elevational view thereof.
Figure 4:
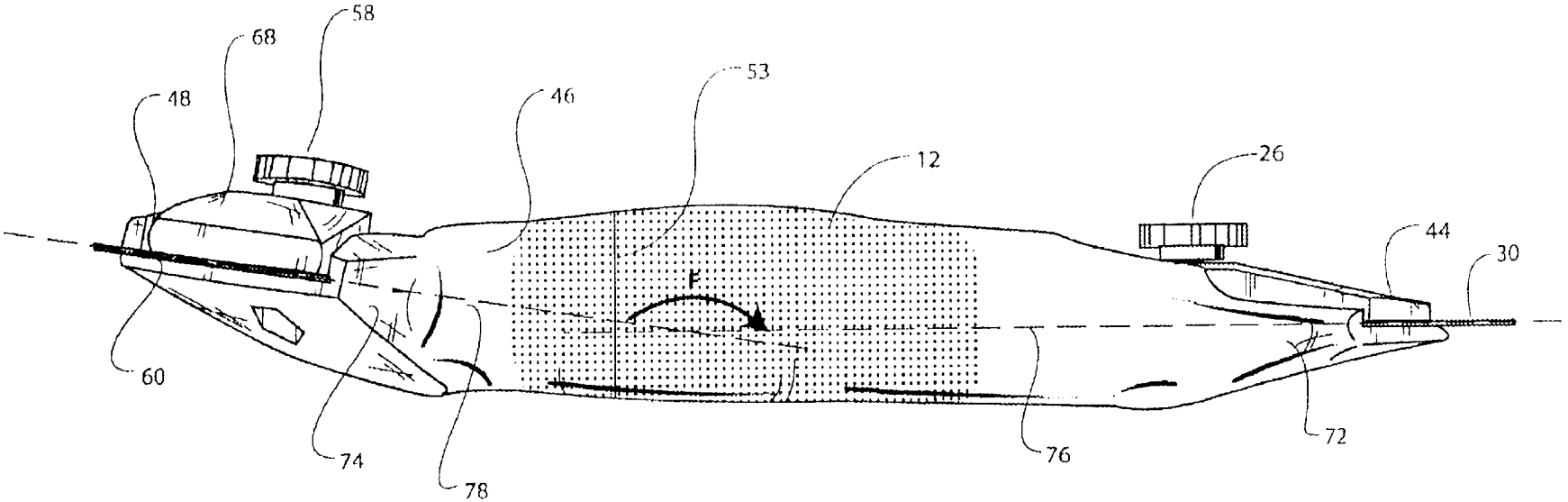
FIG. 4 is a side elevational view of the invention showing the difference in angulation of the respective planes of the utility knife portion of a tool versus the non-utility knife portion thereof.
Figure 5A:
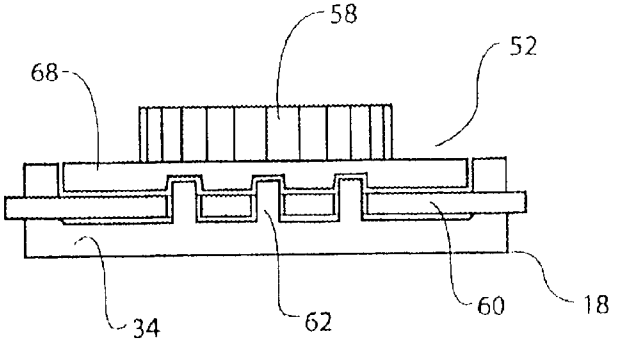
FIG. 5A is a front plan view of the non-universal portion of the work knife showing the blade holding means associated therewith.
Figure 5:
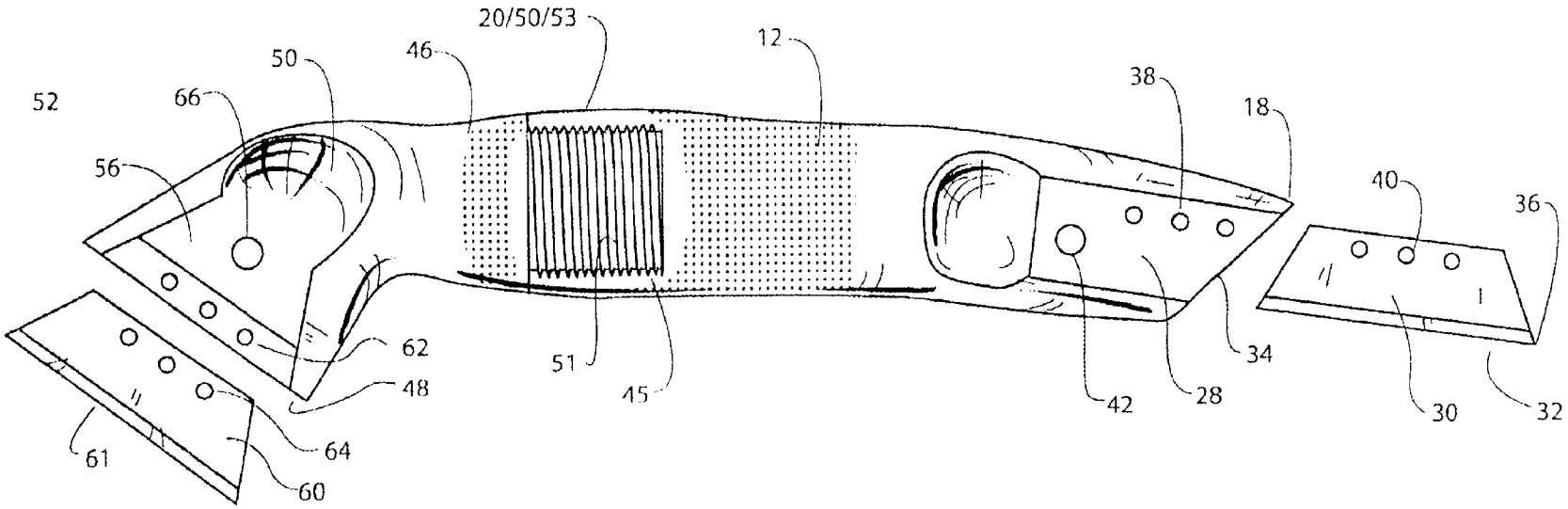
FIG. 5 is a top plan exploded view of the multi-purpose work knife.
Figure 6:
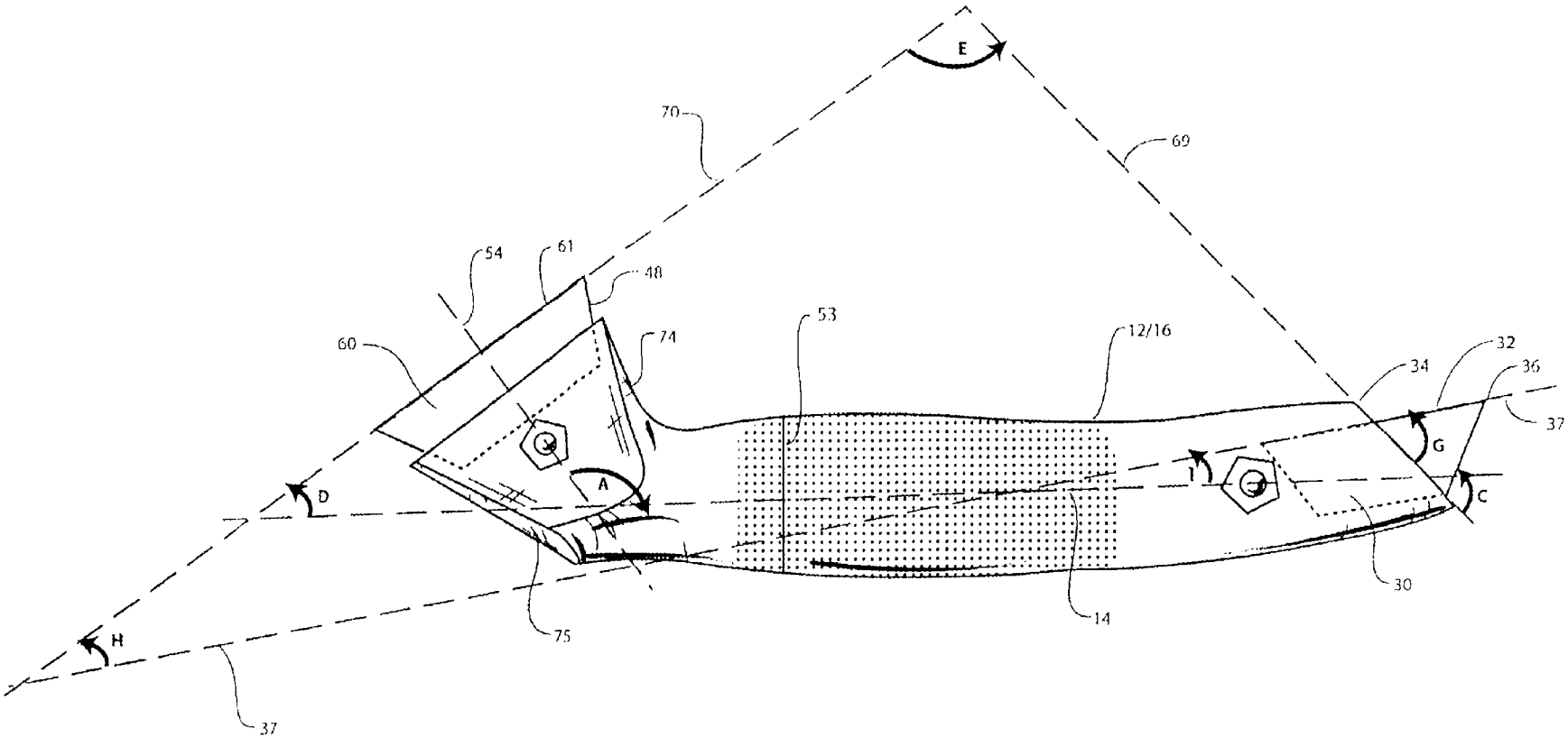
FIG. 6 is a bottom view of the inventive knife particularly showing the relationship between the various virtual axes which define the invention.

With further reference to FIGS. 1 to 6, it is noted that the universal handle 12 includes a first end 18 and a second end 20. Upon a top surface of said universal handle is provided a knife-blade holding assembly 22 which includes several constituent elements, these including a thumb recess 24, a blade control knob 26 and a blade channel 28. A utility knife blade 30 and its cutting edge 32 are held within channel 28 and adjustably positioned by the function of knob 26. Therein, blade 30 may, during periods of non-use, be held in a fully withdrawn position as is shown in FIGS. 2 and 3. Therein, said utility knife blade 30 will reside slightly inwardly of distal edge 34 of first end 18 of universal handle 12. Said edge defines an axis 69 (see FIG. 2) which exhibits an angle B of about 20 degrees relative to said UEH axis 14. When knob 26 is employed to facilitate the fullest possible extension of utility knife blade 30, cutting edge 32 thereof and its associated point 36 will project well beyond distal edge 34 end of first end 18 of universal handle 12 of the work knife 10. It is to be appreciated that the views of FIGS. 1 and 6 show the inventive knife with UEH blade 30 inserted within holding assembly 22, while that of FIGS. 2, 3, and 5 show the work knife and holding means 22 without blade 30. It is further noted that said cutting edge 32 defines an axis 37 which exhibits an angle G relative to distal edge 34, and an angle I relative to UEH axis 14.

A variety of strategies may be employed to secure blade 30 within holding assembly 22. One such strategy is shown in the views of FIG. 5. Therein, channel 28 is provided with a linear plurality of pins 38 which are placed and dimensioned for complemental engagement of apertures 40 within the blade 30. This approach enables a user to select a desired degree of extension of blade 30 from distal edge 34 of first end 18 of the universal handle 12. Also shown is knob 26 of holding assembly 22 having an axle (not shown) which threadly engages a vertical bore 42 within said channel 28 of the holding assembly 22. It should be appreciated that holding assembly 22 further includes a hold-down plate 44 which is also secured by knob 26, this to maintain stability of blade 30 within the assembly 22 and to contribute to the safety and aesthetics associated with the entire structure.

Figure 7:
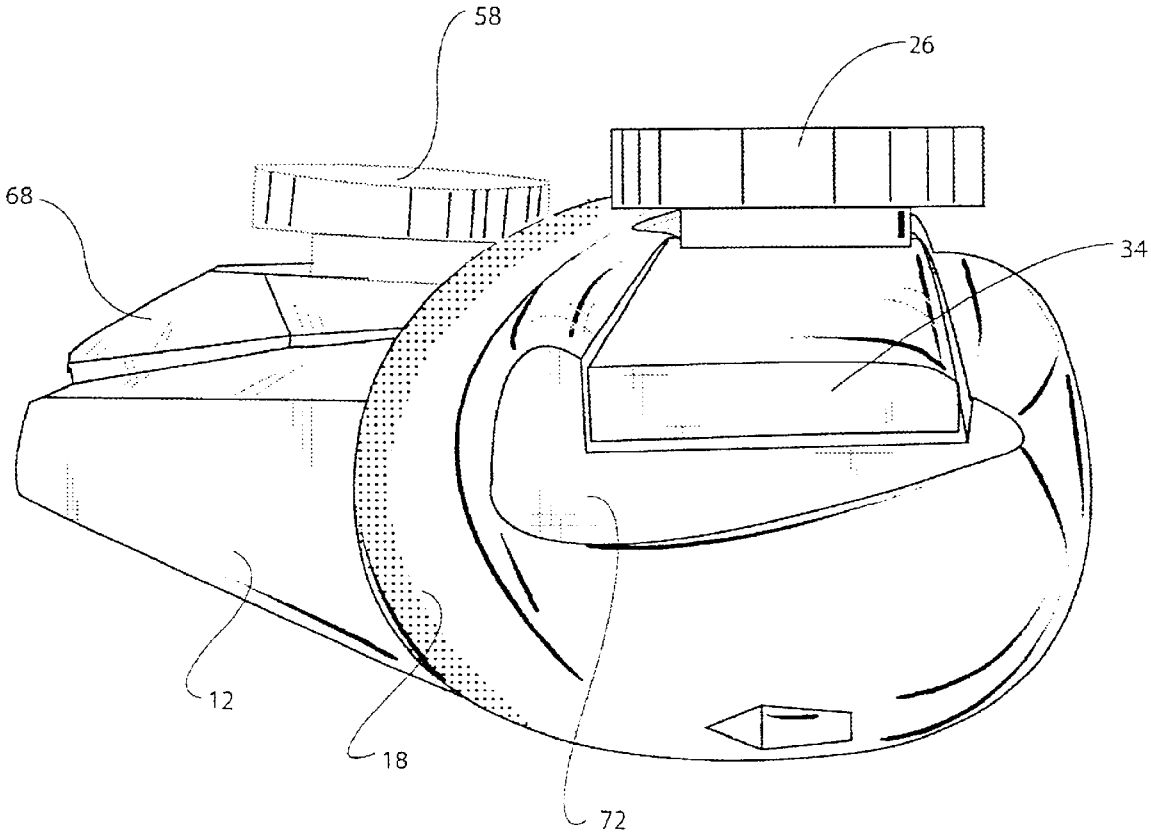
FIG. 7 is a front elevational view of the universal handle portion of work knife.
Figure 8:
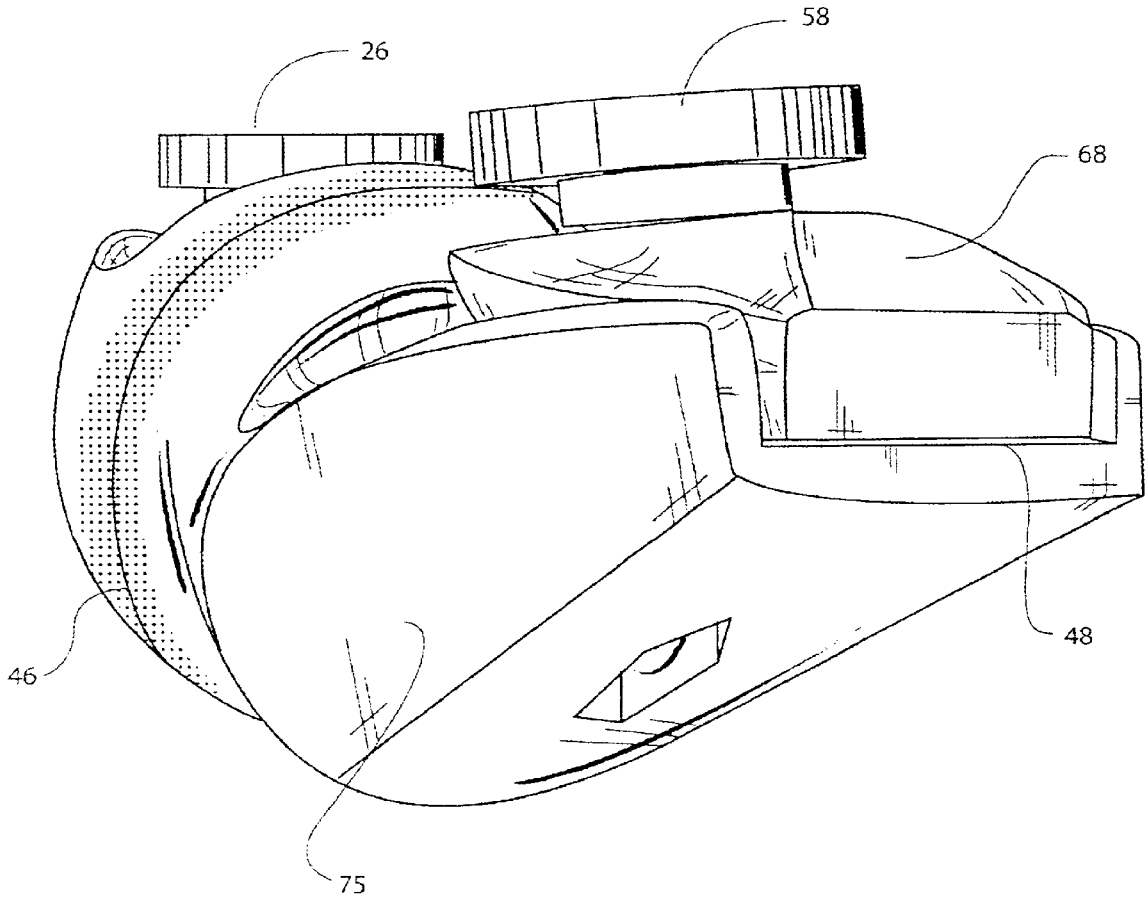
FIG. 8 is a front elevational view of the selectable non-universal portion of the inventive multi-purpose work knife.

As may be noted with reference to the perspective views of FIGS. 1, 7, and 8, radial cross-sections of universal handle 12 defines substantially oval cross-sections between said thumb recess 24 of the holding assembly 22 and second end 20 of the universal handle 12. Included within said second end 20 of universal handle 12 is female means 45 or complemental securement means, later described below.

With reference to the views of FIGS. 1 through 6, the inventive handheld utility knife 10 may be seen to further include a selectable non-universal portion ("SNP") 46 having a first end 48 and a second end 50 having a male means 51 is proportioned for complemental engagement with female means 45 of second end 20 of said universal handle 12. See FIG. 5. It is further noted that said UEH axis 14 (see FIG. 2) of said universal handle extends through interface 53 which exists at a complemental joinder between said first ends 20 and 50 and into said non-universal portion 46 to a thumb recess 50 which is associated with a blade holding assembly 52 of said non-universal portion 56, having an axis 54. See FIGS. 2 and 6. It is to be appreciated that, in a preferred embodiment, the inventive utility knife will be sold in a kit which is provided with both a left and a right hand embodiment of said non-universal portion 46, this to accommodate the needs of respective right and left handed workers and, as well, to accommodate particular work or cutting environments in which the use of either a left or right handed non-universal portion 46 would be particularly advantageous to the worker without regard to whether the worker is right or left handed. That is, there exist numerous work environments and work spaces in which the desired angle of cut for the work project, or preferred leverage of the worker, is more readily achieved with a non-universal portion directed either to the left or to the right of said UEH axis 14 of universal handle 12. It is, thereby, to be understood that while the within drawings, and associated description, describe a selectable non-universal portion 46 which, in top view, projects to the left relative to said UEH axis 14, the instant invention is equally applicable to the use of a selectable non-universal portion which is substantially a mirror image of the non-universal portion 46 shown in the figures and which, thereby, would project to the right relative to said axis 14. An angulation A of this projection is defined by said axis 54 (see FIG. 2) of non-universal portion 46 relative to UEH axis 14. This angulation falls in a range of about 110 to about 140 degrees.

Said holding assembly includes a substantially triangular recess 56 (see FIGS. 2 and 5) as well as a securement knob 58.

As may be noted in FIGS. 1, 5, 5A, and 6, holding assembly 52 is adapted for the securement of a substantially triangular blade 60 or a blade having the general geometry of a parallelogram, and having a cutting edge 61 substantially parallel to an edge of said SNP first end.

It is, however, to be noted that the holding assembly 52 of non-universal portion 56 is adapted to secure transverse, as opposed to longitudinal, movement of blade 60. This may be more fully appreciated with reference to the view of FIG. 5A in which there is shown a plurality of projections 62 from triangular recess 56 of non-universal portion 46. Provided on blade 60 is a corresponding plurality of apertures 64 to permit the positioning of blade 60 upon the projections 62 of channel 56. As in the case of first holding assembly 22, knob 58 includes an axle, not shown, which threadly engages a vertical bore 66 (see FIG. 5) to selectably effect the positioning and securement of a hold down piece 68 (see FIGS. 4 and 8) upon blade 60.

One distinguishing parameter of the present invention is that an axis 67 of channel 28 of first holding assembly 22 will, at a point of intersection with UEH axis 14 and, at the axis of rotation of knob 26, define an acute angle B in a range of 10 to 25 degrees. (See FIG. 2). It is further noted that, in a preferred embodiment, distal edge 34 of first end 18 of universal handle 12 defines an axis 69 which intersects said UEH axis 14 at an angle C which is in a range of 40 to 50 degrees, and which is substantially parallel with said axis 54 of said SNP blading holding assembly 52. See FIGS. 2 and 6.

Generally, first end 48 of non-universal portion 46 is linear and defines an axis 70 which, while substantially normal to said axis 54, intersects said UEH axis 14 (to the left of non-universal portion 46) at a virtual angle D which is in a range of 20 to 40 degrees. This angle will be substantially the same in either the left or right-handed embodiment of the non-universal portion. In the left handed embodiment thereof, i.e., in the embodiment shown in figures, said axis 69, corresponding to a virtual extension of said edge 34 of first end 18 of universal portion 12, will intersect with said axis 70 at an angle E which is typically in a range of 80 to 120 degrees.

It has also been found that such an angulation H of axis 70 of the edge 61 of SNP blade 60 relative to axis 37 of edge 32 of UEH blade 30 produces an advantageous leverage to a user of the present work knife, if it is in a range of 20 to 40 degrees. It is to be appreciated that the flared structure of triangular blade 60 of the non-universal portion will have cutting, scraping, grouting, plastering and other applications which will enhance the generalized utility of the present invention.

The utility of the invention is also furthered by triangular side surfaces 72, 74 and 75 (see FIGS. 4 to 8) of the handles as well as the relative positioning of plane 76 of utility knife blade 30 relative to plane 78 which is defined by triangular blade 60 (see FIG. 4). Therein, it has been found that an obtuse angle F, formed at an intersection of said planes in a range of 160 to 170 degrees, is most useful. That is, the advantages of the invention are yet further enhanced by such relative angulation F of planes 76 and 78 relative to each other.

It is to be appreciated that said SNP may selectably take several forms including a left angled axis relative to the axis of the UEH, a right angled axis relative thereto, and an axis substantially co-linear with said UEH axis.

While there has been shown and described the preferred embodiment of the instant invention, it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

Having thus described my invention what I claim as new, useful, and non-obvious and, accordingly, secure by Letters Patent of the United States is:

1. A multi-purpose work knife, comprising:

(a) a universal elongate handle ("UEH") extending generally upon a UEH axis, said handle having a compound, convex curvature and an assembly within, at a top surface of a first end of said UEH, for holding a UEH utility knife blade in a selectable longitudinal position defined by a cuffing edge of said UEH blade, said UEH also defining substantially oval radial cross-sections between said blade holding assembly and a second end thereof, said cross-sections defining slightly smaller radii at about a center region of said UEH, said second end comprising complemental securement means; and (b) a selectable non-universal portion ("SNP") having a first end and a second end, said second end comprising means for selectable complemental securement to said UEH complemental securement means, said second end of said SNP having a continuity of curvature with said second end of said UEH at opposing surfaces thereof, said UEH axis passing through said complemental securement means of said surfaces of said second ends of said UEH and SNP respectively, said SNP further comprising at a first end and top surface thereof, and assembly for selectably holding a knife blade having a cutting edge projecting away from said first end of said SNP, in which said cutting edge of said SNP blade defines an angle H which intersects said axis of UEH blase, at a virtual extension external to said work knife in a range of about 20 to about 40 degrees.

2. The work knife as recited in claim 1 in which:

(c) said holding assembly of said UEH includes an adjustment knob having an axis of rotation; and (d) said cutting edge of said UEH blade defines an angle I in a range of about 10 to about 25 degrees relative to said UEH axis.

3. The work knife as recited in claim 2, in which said knife blade holding assembly of said SNP defines an axis which defines an angle A in a range of about 110 to about 140 degrees relative to said UEH axis.

4. The work knife as recited in claim 3, in which an intersection of an axis of said first end of said UEH and an axis of said first end of SNP defines an angle E in the range of about 90 to about 130 degrees.

5. The work knife as recited in claim 4, in which holding assemblies associated with each of said UEH and SNP are symmetric about substantially horizontal planes defined by respective blades held therein.

6. The work knife as recited in claim 4, in which a distal edge of said first end of said UEH defines an angle G in a range of about 45 to about 75 degrees relative to said cutting edge of said UEH blade.

7. The work knife as recited in claim 6, in which a distal edge of said first end of said SNP is substantially parallel to said cutting edge of said SNP blade.

8. The work knife as recited in claim 7, in which said first end of said SNP defines an angle D in a range of about 20 to about 45 degrees relative to said UEH axis.

9. The work knife as recited in claim 7, in which said axis of said SNP blade holding assembly is substantially parallel to said distal edge of said first end of said UEH.

10. The work knife as recited in claim 1, in which said knife blade holding assembly of said SNP defines an axis which defines an angle A in a range of about 110 to about 140 degrees relative to said UEH axis.

11. The work knife as recited in claim 10, in which said cutting edge of said UEH blade defines an angle I in a range of about 10 to about 25 degrees relative to said UEH axis.

12. The work knife as recited in claim 11, in which said UEH is partially hollow, so that extra blades may hold therein.

13. The work knife as recited in claim 11, in which said axis of said holding assembly of said SNP may exist either to the left or right of said UEH axis.

14. The work knife as recited in claim 11, in which said axis of said holding assembly of said SNP may exist either to the left or right of said firs UEH axis.

15. The work knife as recited in claim 10, in which said axis of said holding assembly of said SNP may exist either to the left or right of said firs UEH axis.

16. The work knife as recited in claim 1, in which an angle F of intersection of virtual planes defined by planes of said UEH and SNP blades comprises a range of about 155 to abut 170 degrees.

* * * * *